US005135054A

United States Patent [19]

Nimitz et al.

[11] Patent Number: 5,135,054

[45] Date of Patent: * Aug. 4, 1992

[54] FIRE EXTINGUISHING AGENTS FOR FLOODING APPLICATIONS

[75] Inventors: Jonathan S. Nimitz; Robert E. Tapscott; Stephanie R. Skaggs, all of Albuquerque, N. Mex.

[73] Assignee: University of New Mexico, Albuquerque, N. Mex.

[ * ] Notice: The portion of the term of this patent subsequent to Apr. 7, 2009 has been disclaimed.

[21] Appl. No.: 593,773

[22] Filed: Oct. 5, 1990

[51] Int. Cl.[5] ..... A62C 3/00; A62D 1/00

[52] U.S. Cl. ..... 169/46; 252/2; 252/8; 252/601; 106/18.24; 169/44

[58] Field of Search ..... 252/8, 601, 2; 169/46, 169/44; 106/18.24

[56] References Cited

U.S. PATENT DOCUMENTS

| | | | |
|---|---|---|---|
| 3,479,286 | 11/1969 | Gambaretto | 252/8 |
| 3,480,545 | 11/1969 | Dale | 252/2 |
| 3,657,120 | 4/1972 | Porst | 252/8 |
| 3,822,207 | 7/1974 | Howard | 252/8 |
| 3,879,297 | 4/1975 | Langville et al. | 252/8 |
| 4,226,728 | 10/1980 | Kung | 252/8 |
| 4,830,762 | 5/1989 | Yamaguchi et al. | 252/2 |
| 4,954,271 | 9/1990 | Green | 252/8 |

OTHER PUBLICATIONS

"Fire Protection Handbook" Fourteenth Edition, by Gordon P. McKinnon et al. *National Fire Protection Association.*

"Final Report on Fire Extinguishing Agents" by Purdue Research Foundation and Dept of Chemistry with Army Engineers Research and Development Labs Fort Belvoir, 1950.

*Primary Examiner*—Richard D. Lovering
*Assistant Examiner*—N. Bhat
*Attorney, Agent, or Firm*—Deborah A. Peacock; Donovan F. Duggan; William E. Eklund

[57] ABSTRACT

A set of fire extinguishing agents suitable for total flood fire suppression applications is disclosed. The agents are characterized by high extinguishment efficiency, low toxicity, and low ozone depletion potential. The agents are partially or completely fluorinated alkanes having at least two carbon atoms.

3 Claims, No Drawings

FIRE EXTINGUISHING AGENTS FOR FLOODING APPLICATIONS

Government Rights

This invention was made with support by the U.S. Government. The Government may have certain rights in this invention.

Cross-Reference to Related Applications

A related application entitled Fire Extinguishing Agents for Streaming Applications, is being filed concurrently herewith, and the specification thereof is incorporated herein by reference.

BACKGROUND OF THE INVENTION

1. Field of the Invention.

The invention described and claimed herein is generally related to fire extinguishing agents. More particularly the present invention is related to halogenated alkane fire extinguishing agents.

2. Background Art.

The halogenated fire extinguishing agents are generally alkanes in which one or more hydrogen atoms have been replaced by halogen atoms consisting of fluorine, chlorine, bromine or iodine.

The hydrocarbons from the which halogenated extinguishing agents are derived, for example methane and ethane, are generally volatile and highly flammable gases at room temperature. Substitution of halogens for the hydrogen atoms in such hydrocarbon compounds reduces both the volatility and the flammability of the compound. Sufficient substitution of halogen atoms for hydrogen results in inflammable liquids which are useful as fire extinguishing agents.

Some general observations can be made regarding the relative effects of halogenation of the lower alkanes. Generally, for example, increasing bromine substitution results in increasing boiling point and flame extinguishment properties. Fluorine substitution has much less effect on boiling point, but results in inflammability and lower toxicity than bromine. Chlorine substitution is intermediate between fluorine and bromine. Iodine is rarely utilized because the iodoalkanes are too toxic and unstable.

The use of certain halogenated alkanes as fire extinguishing agents has been known for many years. For example, fire extinguishers containing carbon tetrachloride and methyl bromide were used in aircraft applications as early as the 1920's. Over a period of years the toxicity of these compounds was recognized and they were replaced with less toxic compounds. Chlorobromomethane was used in aircraft applications from 1950s to the 1970s. A major study of halogenated alkanes as fire extinguishing agents was conducted by the Purdue Research Foundation for the U.S. Army from 1947 to 1950. That study remains the basis for the use of a number of halogenated alkanes in specific fire extinguishing applications.

Further discussion of the halogenated alkanes requires understanding of the two major nomenclature systems that are used in addition to the chemical nomenclature. The "Halon" system was devised by the U.S. Army Corps of Engineers and primarily refers to halogenated alkanes containing bromine and fluorine used as fire extinguishing agents. In accordance with this system, the first digit of a Halon number refers to the number of carbon atoms; the second digit refers to the number of fluorine atoms in the compound; the third digit refers to the number of chlorine atoms; the fourth digit refers to the number of bromine atoms; and the fifth digit refers to the number of iodine atoms. Terminal zeroes are not expressed. Thus, for example, bromotrifluoromethane ($CBrF_3$) is referred to as Halon 1301; having one carbon, three fluorines, no chlorines, one bromine and no iodines. Likewise, dibromodifluoromethane is designated Halon 1202.

The chlorofluorocarbon, or "CFC," system of nomenclature was developed primarily with regard to refrigerants, which generally contain chlorine and/or fluorine, and which are generally free of bromine and iodine. Under this system the first digit represents the number of carbon atoms minus one (and is omitted if zero); the second digit represents the number of hydrogen atoms plus one; and the third digit represents the number of fluorine atoms. Unless otherwise indicated, all remaining atoms in the compound are assumed to be chlorine. Thus, for example, CFC 23 represents trifluoromethane ($CHF_3$).

The 1950 Purdue report resulted in four halons being identified for widespread fire extinguishment use. Halon 1301 (bromotrifluoromethane) was identified as the least toxic and second most effective agent, and consequently has found widespread application as the standard choice in "total flood" applications, which are applications in which the agent is stored and discharged in occupied spaces, such as computer facilities or restaurant kitchens, often by an automatic discharge system. Halon 1211 is more toxic than Halon 1301 and consequently is not used in total flood applications. However, it has has good extinguishment effectiveness, and consequently has become the standard for "streaming" applications, which are those applications where the agent is applied from wheeled or portable units which are manually operated.

The halogenated hydrocarbons operate as fire extinguishing agents by a complex chemical reaction mechanism involving the disruption of free-radical chain reactions. They are desirable as fire extinguishing agents because they are clean and effective; because they leave no residue; and because they do not damage equipment or facilities to which they are applied.

As indicated above, for a number of years the toxicity of the halogenated alkanes has been an issue in their selection as fire extinguishment agents. Even more recently, the ozone depletion potential of halogenated hydrocarbons has come to be recognized. The depletion of ozone in the atmosphere results in increased levels of ultraviolet radiation at the surface of the earth and also contributes to the problem of global warming. These problems are considered so serious that the 1987 Montreal Protocol includes international restrictions on the productions of volatile halogenated alkanes.

Accordingly, it is the object and purpose of the present invention to provide clean, relatively non-toxic, effective fire extinguishing agents which have low ozone depletion potentials.

It is another object and purpose of the present invention to attain the foregoing objects and purposes in fire extinguishing agents which are particularly useful in flooding applications.

SUMMARY OF THE INVENTION

The present invention provides a set of halogenated alkanes and their use as fire suppression agents in total flood applications. The compounds of the present invention meet certain combined criteria, including minimum fire extinguishment efficiency, low toxicity and low ozone depletion potential. The compounds comprise the halogenated alkanes selected from the group consisting of: pentafluoroethane ($CF_3CHF_2$); 1,1,2,2-tetrafluoroethane ($CHF_2CHF_2$); 1,1,1,2-tetrafluoroethane ($CH_2FCF_3$); 1,1,1-trifluoroethane ($CF_3CH_3$); perfluorocyclopropane (cyclo-$(CF_2)_3$); perfluoropropane ($CF_3CF_2CF_3$); 20-chloro-1,1,1,2-tetrafluoroethane ($CHClFCF_3$); and perfluoro-cyclobutane (cyclo-$C_4F_8$).

These and other aspects of the present invention will be more apparent upon consideration of the following detailed description of the invention, when taken with the accompanying drawings.

DESCRIPTION OF THE PREFERRED EMBODIMENT

Chlorine- and bromine-containing halogenated alkanes are in most cases effective fire suppression agents. However, they are known to contribute to the depletion of ozone in the atmosphere, with bromine posing a greater problem than chlorine. The perfluorocarbons and hydroflourocarbons are generally considered to have no ozone depletion potential.

In general, the amount of hydrogen in a molecule must be low enough to ensure that the compound is not flammable. In general, halogenated alkanes having three or more hydrogen atoms are at risk of being flammable at some concentrations in air.

The molecular weights and boiling points of the halogenated alkanes are also factors in their effectiveness as fire suppression agents. The vapor pressure should be high enough at room temperature that the agent can be rapidly dispersed, but not so high as to require high temperature equipment to contain it. Adequate vapor pressures are generally obtained in compounds having boiling points of below −20° C., in order that the compound can be adequately dispensed at ambient temperatures, and above −150° C. in order to avoid the necessity of high pressure containment systems.

The primary chemical mechanism by which halogenated alkanes suppress fires involves the termination of free-radical reactions that sustain combustion. Bromine-substituted compounds have long been known to be effective in this role. The most important reaction occurring in the early stages of suppression appears to be bromine abstraction by monoatomic hydrogen radicals.

In addition to the chemical reactions which halogenated alkanes undergo to suppress fires, heat removal is an important mechanism for fire suppression. For effective heat removal, an agent must have a high vapor heat capacity and a high heat of vaporization. The vapor heat capacity should be greater than approximately 0.09 cal/g°C. and the heat of vaporization should be greater than approximately 25 cal/g.

Suitable halogenated alkanes must also be chemically stable during storage at ambient temperatures over long periods of time, and must be unreactive with the containment systems in which they are housed.

The ozone depletion potential of a fire suppression agent is also important. In the present invention the criteria of an ozone depletion potential of 0.05 or less was chosen as a screening factor. Halon fire suppression agents currently used have high ozone depletion factors because they generate bromine radicals in the stratosphere. As a class, the existing halons have ozone depletion potentials ranging from approximately three to ten. As noted above, the perfluoroalkanes are generally recognized as having no ozone depletion potential.

Halogenated alkanes having chlorine have some ozone depletion potential due to the potential for the formation of chlorine radicals in the atmosphere. This potential can be reduced by using compounds having hydrogen atoms in addition to the chlorine, because the hydrogen is more accessible for abstraction by hydroxyl radicals in the atmosphere, leading to the decomposition of the compound.

The compounds of the present invention are also selected on the basis of their global warming factor, which is increasingly being considered along with ozone depletion factors. Global warming is caused by absorption of infrared radiation in the atmosphere. It is recognized that some halons and chlorofluorocarbons have global warming factors ranging up to several thousand times that of carbon dioxide.

There are several principal adverse short- and long-term effects of halogenated alkanes. First, they can stimulate or suppress the central nervous system to produce symptoms ranging from lethargy and unconsciousness to convulsions and tremors. Second, halogenated alkanes can cause cardiac arrythmias and can sensitize the heart to adrenaline, which can pose an immediate hazard to fire fighters working in a high stress environment. Third, inhalation of halogenated alkanes can cause bronchoconstriction, reduce pulmonary compliance, depress respiratory volume, reduce mean arteria blood pressure, and produce tachycardia. Long term effects can include hepatotoxicity and other effects.

Fire extinguishing agents used in streaming applications are applied by portable extinguishers which are handheld or truck-mounted or the like, Since they are manually actuated and are used for local applications, they can be slightly more toxic than extinguishing agents used in flooding applications.

Several criteria were used for selection of the preferred embodiments of the present invention.

With regard to toxicity, each of the preferred compounds is characterized by a toxicity no greater than that of Halon 1211 (bromochlorodifluoromethane), which is the most widely accepted streaming agent in industry. In this regard, toxicity was measured as $LC_{50}$ (lethal concentration at the fifty percent level) for rats over an exposure period of 20 minutes.

The criterion for fire extinction capacity was an extinguishment concentration based on a standard cup burner test, using n-heptane and the test fuel. For flooding applications the minimum level of efficiency is 200% of the amount of Halon 1301 (i.e. must be at least half as effective as 1301) required in a total flood application.

The compounds meeting the selected criteria are set forth in Table I below.

TABLE I

| CFC No. | Formula | Name |
|---|---|---|
| 124 | $CHClFCF_3$ | 2-chloro-1,1,1,2-tetrafluoroethane |
| 125 | $CHF_2CF_3$ | pentafluoroethane |
| 134 | $CHF_2CHF_2$ | 1,1,2,2-tetrafluoroethane |
| 134a | $CF_3CH_2F$ | 1,1,1,2-tetrafluoroethane |
| 143a | $CF_3CH_3$ | 1,1,1-trifluoroethane |
| C216 | cyclo-$(CF_2)_3$ | perfluorocyclopropane |
| 218 | $CF_3CF_2CF_3$ | perfluoropropane |
| C318 | cyclo-$C_4F_8$ | perfluorocyclobutane |

Characteristic data for the compounds listed in Table I are set forth in Table II below.

TABLE II

| CFC No. | Compound | B.P. (°C.) | ODP | Flame Suppression Conc. (volume %) | $LC_{50}$ |
|---|---|---|---|---|---|
| 124 | $CHClFCF_3$ | −12 | 0.02 | 9 | 21 |
| 125 | $CHF_2CF_3$ | −48 | 0.0 | 9 | >10 |
| 134 | $CHF_2CHF_2$ | −23 | 0.0 | 16 | — |
| 134a | $CH_2FCF_3$ | −27 | 0.0 | 10 | 50 |
| 143a | $CF_3CH_3$ | −48 | 0.0 | 20 | — |
| c-216 | cyclo-$(CF_2)_3$ | −31 | 0.0 | 11 | — |
| 218 | $CF_3CF_2CF_3$ | −36 | 0.0 | 6 | — |
| c-318 | cyclo-$C_4F_8$ | −4 | 0.0 | 8 | >80 |

The ozone depletion potential is in each case relative to CFC-11 ($CFCl_3$, or chlorotrichlormethane), which has a value of 1.0.

Blends of the foregoing compounds are also preferred, particularly where azeotropic mixtures result, which are characterized by constant boiling points and compositions upon volatilization, resulting in constant composition as the agent is discharged.

Also, mixtures are preferred because synergistic results are occasionally observed. For example, a low boiling point component can provide rapid knockdown of flames, while a high boiling point component can prevent burnback and inert a fuel surface.

The present invention has been described and illustrated with reference to certain preferred embodiments. Nevertheless, it will be understood that various modifications, alterations and substitutions may be apparent to one of ordinary skill in the art, and that such modifications, alterations and substitutions may be made without departing from the essential invention. Accordingly, the present invention is defined only by the following claims.

The embodiments of the invention in which patent protection is claimed are:

1. A method of using a fire extinguishing agent comprising the steps of:

a) storing the fire extinguishing agent in an automatic discharge system;

b) automatically discharging the fire extinguishing agent upon a fire being sensed by the automatic discharge system; and c) flooding the fire with the fire extinguishing agent, wherein the fire extinguishing agent consists of a halogenated alkane composition selected from the group consisting of pentafluoroethane ($CF_3CHF_2$); 1,1,2,2-tetrafluoroethane ($CHF_2CHF_2$); 1,1,1,2-tetrafluoroethane ($CH_2FCF_3$); 1,1,1-trifluoroethane ($CF_3CH_3$); perfluorocyclopropane (cyclo-$(CF_2)_3$); perfluoropropane ($CF_3CF_2CF_3$); 2-chloro-1,1,1,2-tetrafluoroethane ($CHClFCF_3$); perfluorocyclobutane (cyclo-$C_4F_8$); and mixtures thereof.

2. A fire extinguishing agent for flooding applications consisting solely of mixtures of halogenated alkane compositions selected from the group consisting of pentafluoroethane ($CF_3CHF_2$); 1,1,2,2-tetrafluoroethane ($CHF_2CHF_2$); 1,1,1,2-tetrafluoroethane ($CH_2FCF_3$); 1,1,1-trifluoroethane ($CF_3CH_3$); perfluorocyclopropane (cyclo-$(CF_2)_3$); perfluoropropane ($CF_3CF_2CF_3$); 2-chloro-1,1,1,2-tetrafluoroethane ($CHClFCF_3$); and perfluorocyclobutane (cyclo-$C_4F_8$).

3. A fire extinguishing composition consisting of a halogenated alkane selected from the group consisting of: 9% by volume in air of 2-chloro-1,1,1,2-tetrafluoroethane ($CHClFCF_3$); 9% by volume in air of pentafluoroethane ($CF_3CHF_2$); 16% by volume in air of 1,1,2,2-tetrafluoroethane ($CHF_2CHF_2$); 10% by volume in air of 1,1,1,2-tetrafluoroethane ($CH_2FCF_3$); 20% by volume in air of 1,1,1-trifluoroethane ($CF_3CH_3$); 11% by volume in air of perfluorocyclopropane (cyclo-$(CF_2)_3$); 6% by volume in air of perfluoropropane ($CF_3CF_2CF_3$); and 8% by volume in air of perfluorocyclobutane (cyclo-$C_4F_8$); and mixtures thereof; wherein each of said percentage volumes in air is at least 200% of the amount of Halon 1301 required in a total flood application.

* * * * *